United States Patent [19]

deVolpi

[11] 4,153,157

[45] May 8, 1979

[54] PACKAGING OF GIFT WRAP SHEET MATERIAL

[75] Inventor: Charles P. deVolpi, St. Sauveur des Monts, Canada

[73] Assignee: Perkins Papers Ltd., Laval, Canada

[21] Appl. No.: 880,122

[22] Filed: Feb. 22, 1978

[51] Int. Cl.[2] ..... B65D 69/00; B65D 71/00

[52] U.S. Cl. ..... 206/225; 206/407; 206/226

[58] Field of Search ..... 206/225–226, 206/391, 393–394, 412, 443, 446, 499; 220/8; 229/87 R, 93

[56] References Cited

U.S. PATENT DOCUMENTS

| | | | |
|---|---|---|---|
| 1,951,561 | 3/1934 | Robichaud | 206/226 |
| 2,345,190 | 3/1944 | Freund | 206/226 |
| 2,357,908 | 9/1944 | Pike | 206/407 |
| 3,441,127 | 4/1969 | Manning | 206/225 |

FOREIGN PATENT DOCUMENTS

| | | | |
|---|---|---|---|
| 627261 | 8/1949 | United Kingdom | 206/226 |

*Primary Examiner*—Davis T. Moorhead

*Attorney, Agent, or Firm*—Swabey, Mitchell, Houle, Marcoux & Sher

[57] ABSTRACT

There is a plurality of lengths of gift wrap sheet material of different patterns, color or finish on a single core, each sheet having a different width such that the under-rolled sheet is partially exposed for visual appreciation, the whole being overwrapped by a transparent film.

5 Claims, 3 Drawing Figures

PACKAGING OF GIFT WRAP SHEET MATERIAL

BACKGROUND OF THE INVENTION

1. Field of the Invention

The present invention relates to packaging of sheet material, and particularly to the packaging and displaying of gift wrap sheet material.

2. Description of the Prior Art

In the field of gift wrap sheet material, a great variety of patterns, colours and finish must be produced. In the marketing of such sheet material, it has been found that consumers prefer relatively small amounts of any one gift wrap sheet material, but perfer a great variety of patterns. For instance, at gift exchanging occasions such as at Christmas and New Years, a person while wrapping gifts will prefer to have a different appearing gift wrapping for each separate gift. Accordingly, it is not practical for the manufacturer to package large quantities of one type of gift wrap sheet material for retail sale. Rather, it is wise, from a marketing point of view, to sell packages of gift wrap sheet material containing small amounts but varied sheets.

Gift wrap sheet material is sold generally in rolls with each sheet of a predetermined pattern being on a separate stiff core. During seasons of active gift wrap purchases, such as the pre-Christmas season, it is customary to package two or more rolls in a single transparent package with each roll including a different gift wrap pattern. For the manufacturer, and ultimately for the consumer, the practice of providing a separate stiff core for each roll of a relatively short length of sheet material is expensive and not in the spirit of conservation.

SUMMARY OF THE INVENTION

It is an aim of the present invention to provide a plurality of gift wrap sheet lengths of different patterns, colours or finish in the same package on the same core.

A construction in accordance with the present invention includes a cylindrical core, a first length of gift wrap sheet material having a predetermined width being rolled on said core, at least a second length of gift wrap sheet material having a width less than the width of said first sheet material being rolled concentric with the first length of sheet material and the core and exposing a portion of said first length of sheet material.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENT

Figure 2:
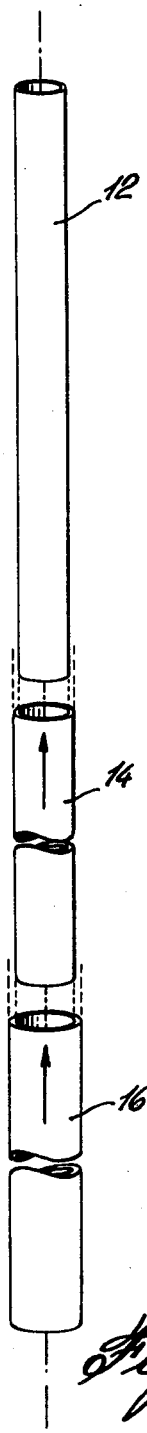
FIG. 2 is an exploded fragmentary view thereof.
Figure 3:
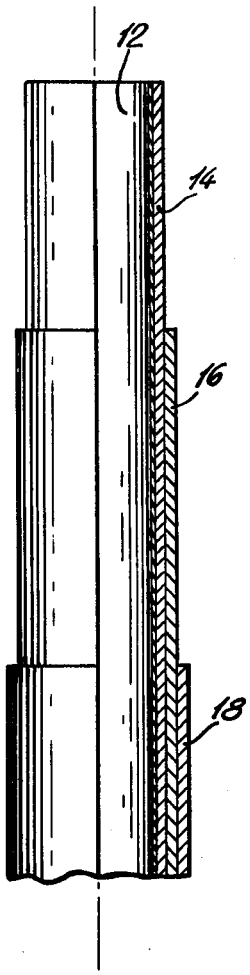
FIG. 3 is an enlarged fragmentary view, partly in cross-section thereof.

Referring to the drawings, there is shown in FIG. 2, for instance, a core 12 which can be made of cardboard or plastics material. Gift wrap as presently marketed is usually rolled on such a conventional core and wrapped with transparent film individually or in groups of two, three or even four. In other words, one relatively short length of gift wrap is provided on each core. As previously discussed in the light of the nature of gift wrap sheet material, only short lengths of gift wrap sheet material are provided on each core, but it is preferable to present a number of different patterns, colours or finish in one package and, therefore, conventionally a number of rolls would be sold in one transparent package, each length having its own core.

According to the present invention, only one core is provided, and a plurality of lengths of gift wrap material of different patterns, colour or finish, is provided on the single core. However, the superimposed rolls of gift wrap material 16 and 18 should be of decreasing width in order to expose the appearance of the under-rolled sheets 14 and 16.

Figure 1:
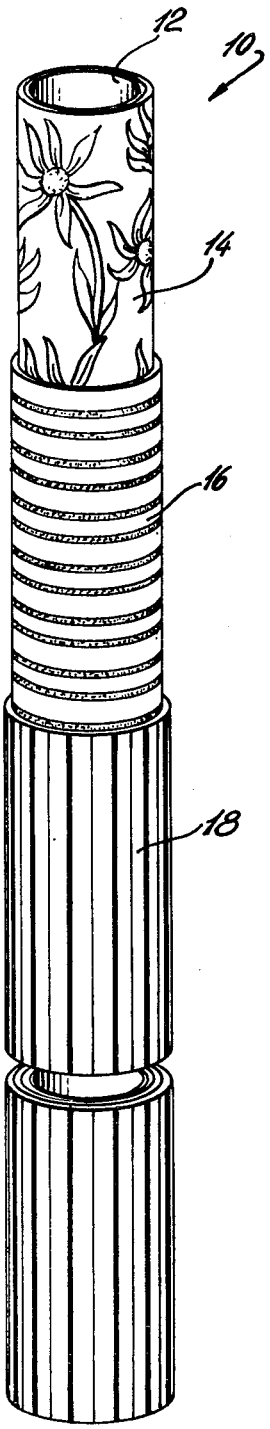
FIG. 1 is a perspective fragmentary view of a roll of gift wrap in accordance with the present invention.

Accordingly, in a particular application as shown in FIG. 1, the package would be made up of the core 12, a first length of gift wrap sheet material 14 rolled on the core 12 and having a width approximately the same as the length of the core 12. A second roll of gift wrap sheet material 16 having a different appearance than the sheet 14 is rolled concentrically about the first sheet 14 on the core 12. The second sheet 16 is of a width narrower than the sheet 14, thus exposing a portion of the sheet 14 so that the consumer can determine the pattern, colour or finish of the first sheet 14. In the present embodiment, a third sheet 18 of yet a different appearance from the sheets 14 and 16, is rolled on the second sheet 16. The gift wrap sheet material 18 is, however, of a narrower width than the sheet 16, thus exposing, as shown in FIG. 1, the sheet 16. Finally, the total package is covered with a transparent film (not shown) with the necessary labeling. The package can be sold, therefore, directly to the consumer showing the three different types of gift wrap sheet material 14, 16 and 18 all on one core.

As far as the width is concerned, it is acceptable that different widths of sheet material be sold for different sizes of gifts to be offered, for instance.

In practice, the number of rolls can vary from two to more, but it is believed that the three sheets would be convenient and sufficient.

It is also contemplated to form packages having two or more cores, but each core has thereon two or more rolls of gift wrap sheet material.

The core could also be longer than the widest roll of sheet material. However, the rolls of sheet material would be staggered in order to expose each roll.

I claim:

1. A package of gift wrap material, including a cylindrical core of a predetermined length, a first length of gift wrap sheet material co-extensive with the core and being rolled onto the core, at least a second length of gift wrap sheet material rolled concentrically onto the first length of sheet material and the core exposing a portion of said first length of sheet material.

2. A package of gift wrap material, including a cylindrical core, a first length of gift wrap sheet material having a predetermined width co-extensive with and being rolled onto said core, at least a second length of gift wrap sheet material having a width less than the width of said first sheet material rolled concentrically onto the first length of sheet material and the core, and exposing a portion of said first length of sheet material.

3. A package as defined in claim 1, wherein yet a third length of sheet material is rolled concentrically on the second length of sheet material and the core, and has a width less than the width of the second length of sheet material such as to expose a portion of the second length of sheet material.

4. A package as defined in claim 1, wherein each succeeding length of sheet material is of a different pattern, colour or finish from the other lengths of sheet material wrapped on the core.

5. A package as defined in claim 1, wherein the core is longer than the widest roll of sheet material and the rolls are staggered on the core in order to expose a portion of each under-rolled sheet.

* * * * *